US007758165B2

(12) United States Patent
Jung et al.

(10) Patent No.: US 7,758,165 B2
(45) Date of Patent: Jul. 20, 2010

(54) INK-JET PRINTHEAD AND MANUFACTURING METHOD THEREOF

(75) Inventors: Myung-song Jung, Gyeonggi-do (KR); Sung-joon Park, Gyeonggi-do (KR); Tae-kyun Kim, Gyeonggi-do (KR); Jae-sik Min, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 276 days.

(21) Appl. No.: 12/000,579

(22) Filed: Dec. 13, 2007

(65) Prior Publication Data

US 2008/0096296 A1 Apr. 24, 2008

Related U.S. Application Data

(62) Division of application No. 10/268,726, filed on Oct. 11, 2002, now Pat. No. 7,341,332.

(30) Foreign Application Priority Data

Nov. 29, 2001 (KR) ..... 2001-74962

(51) Int. Cl.
*B41J 2/04* (2006.01)

(52) U.S. Cl. ..... 347/54; 347/56; 347/63

(58) Field of Classification Search ..... 347/5, 347/9, 54, 56, 63; 438/21
See application file for complete search history.

(56) References Cited

U.S. PATENT DOCUMENTS 5,719,604 A 2/1998 Inui et al.
5,883,650 A 3/1999 Figueredo et al.
5,956,058 A 9/1999 Momose et al.

(Continued)

FOREIGN PATENT DOCUMENTS

JP 2000-141635 5/2000

*Primary Examiner*—Lam S Nguyen
(74) *Attorney, Agent, or Firm*—Staas & Halsey LLP

(57) ABSTRACT

An ink-jet printhead and a manufacturing method thereof include a substrate on which a space portion is formed, a passage plate installed on the substrate in which an ink chamber is formed to store ink, a nozzle plate installed at a top surface of the passage plate in which a nozzle is formed to eject the ink, and a vibration plate disposed between the substrate and the passage plate to generate a pressure for ejecting the ink by changing a volume of the ink chamber. The vibration plate includes a base layer formed at a top surface of the substrate so as to cover at least a part of the space portion, a thin film shape memory alloy layer which contacts the ink contained in the ink chamber and varies according to a temperature variation, a heating element disposed between the base layer and the thin film shape memory alloy to generate heat, and an insulating layer disposed between the heating element and the thin film shape memory alloy layer and transfers the heat generated by the heating element to the thin film shape memory alloy layer. Due to a stable temperature coefficient of resistance (TCR) of the heating element, a height and a width of a voltage supplied to the heat element can be easily controlled, and thus power of the vibration plate can be precisely controlled, thereby having a predetermined image quality, and the heating element does not contact directly the ink, thereby realizing stability of the ink-jet printhead.

19 Claims, 9 Drawing Sheets

U.S. PATENT DOCUMENTS

| | | | |
|---|---|---|---|
| 5,988,799 | A | 11/1999 | Abe et al. |
| 6,126,272 | A | 10/2000 | Ahn |
| 6,130,689 | A | 10/2000 | Choi |
| 6,354,698 | B1 | 3/2002 | Tachihara et al. |
| 6,527,813 | B1 | 3/2003 | Saito et al. |
| 6,652,969 | B1 | 11/2003 | Murakami et al. |
| 6,766,817 | B2 | 7/2004 | da Silva |
| 6,918,404 | B2 | 7/2005 | da Silva |
| 7,066,586 | B2 | 6/2006 | da Silva |
| 7,285,255 | B2 | 10/2007 | Kadlec et al. |

INK-JET PRINTHEAD AND MANUFACTURING METHOD THEREOF

CROSS-REFERENCE TO RELATED APPLICATIONS

This application is a divisional of U.S. application Ser. No. 10/268,726 filed Oct. 11, 2002, issued U.S. Pat. No. 7,341,332, and claims the benefit of Korean Patent Application No. 2001-74962, filed Nov. 29, 2001, in the Korean Intellectual Property Office, the disclosure of which is incorporated herein by reference.

BACKGROUND OF THE INVENTION

1. Field of the Invention

The present invention relates to an ink-jet printhead and a manufacturing method thereof, and more particularly, to an ink-jet printhead using a shape memory alloy and a manufacturing method thereof.

2. Description of the Related Art

In general, an ink-jet printhead is a device printing a predetermined color image on a recording sheet by ejecting a small volume of a droplet of printing ink at a desired position on the recording sheet and generally utilizes a drop on demand (DOD) system injecting the small volume of the droplet of ink on the recording sheet only on demand.

An ink ejection mechanism of the ink-jet printhead using the DOD system includes a heating-type ejecting method of ejecting ink by generating a bubble in ink using a heat source, a vibrating-type ejecting method of ejecting ink by a volume variation of ink caused by a deformation of a piezoelectric device, and an ejecting method using a shape memory alloy to eject ink by the volume variation of ink, which is caused by the shape memory alloy returned to a memorized original state.

In terms of the heating-type ejecting method, a quite great electric power is supplied to a heater within a very short time to supply heat to a chamber of the ink-jet printhead. The heat is generated by the heater having a specific resistance. Heat is transferred from the heater to the ink through an insulating layer contacting ink, and thus a temperature of water-soluble ink rapidly increases over a critical point. Bubbles are formed when the temperature of the water-soluble ink increases over the critical point, and the bubbles push ink corresponding to a volume of bubbles, thereby applying a pressure to circumferential ink. Ink is ejected from a nozzle in response to kinetic energy by the pressure and the volume variation. The ink forms the ink droplet, and the droplet is ejected onto the recording sheet so as to minimize a natural surface energy of the ink.

The heating-type ejecting method involves a difficulty in maintaining a durability of the printhead due to a successive shock caused by the pressure generated when the bubble generated by a thermal energy is destroyed (burst), and in regulating a size of the ink droplet.

In terms of the vibrating-type ejecting method, ink is pushed by applying a pressure to a chamber using piezoelectric characteristics, which cause a force generated when a voltage is applied to a piezoelectric material attached to a diaphragm, to apply pressure to the chamber of the ink-jet printhead.

The ink-jet printhead using the vibrating-type ejecting method is high in cost due to the use of a high-priced piezoelectric element. In addition, since the piezoelectric element must be harmonized with an electrode, an insulating layer, and a protection layer, an ink-jet printhead manufacturing process becomes complicated, and thus yield of the ink-jet printhead decreases.

FIG. 1 is a cross-sectional view of a conventional ink-jet printhead using a shape memory alloy disclosed in U.S. Pat. No. 6,130,689.

Referring to FIG. 1, an ink-jet printhead includes a substrate 10 having a space portion 11, which penetrates therethrough in up and down directions, a vibration plate 12 (12*a*, 12*b*) jointed to an upper portion of the substrate 10 to cover the space portion 11, an electrode 21*a* having one side contacting the vibration plate 12 to supply current to the vibration plate 12, a nozzle plate 18 installed on the substrate 10, in which a nozzle 19 is formed to eject ink 20, a passage plate 13 disposed between the substrate 10 and the nozzle plate 18 in which an ink chamber 14 is formed to store the ink 20, and a passage 16 providing a path through which the ink 20 flows to the ink chamber 14.

In the ink-jet printhead having the above structure, as shown in FIG. 1, the vibration plate 12 is deformed by a residual stress and is bent toward the space portion 11. If current is applied to the vibration plate 20 through the electrode 21*a* from an outside source, the vibration plate 12 moves toward the nozzle plate 18 and then is evenly returned to an original state. Here, a volume of the ink chamber 14 is changed, and the ink 20 is ejected onto a printing sheet from the nozzle 19 by the kinetic energy.

In the ink-jet printhead using the shape memory alloy, a resistivity of the shape memory alloy is less than half of a conventional heating element, and thus a large amount of power must be supplied. In particular, the resistivity is changed, for example, from 70-80 μΩ·cm to 100-120 μΩ·cm when the shape memory alloy is changed from a martensite phase to an austenite phase. Accordingly, a variation range of the supplied power increases, and it becomes difficult to precisely control the supplied power. When the supplied power is not precisely controlled, an amount of the ejected ink cannot be precisely regulated, thereby having no predetermined image quality.

In addition, since the shape memory alloy directly contacts the ink, the current flows directly to the ink from the electrode, and thus a composition of the ink is changed, and a desired ejection of the ink cannot be achieved.

SUMMARY OF THE INVENTION

To solve the above and other problems, it is an object of the present invention to provide an ink-jet printhead having an improved structure in which heat is transferred indirectly to a shape memory alloy using a separate heating element, and a manufacturing method thereof.

Additional objects and advantageous of the invention will be set forth in part in the description which follows and, in part, will be obvious from the description, or may be learned by practice of the invention.

Accordingly, to achieve the above and other objects, according to an embodiment of the present invention, there is provided an ink-jet printhead including a substrate on which a space portion is formed, a passage plate installed on the substrate in which an ink chamber is formed to store ink, a nozzle plate installed at a top surface of the passage plate in which a nozzle is formed to eject ink, and a vibration plate disposed between the substrate and the passage plate to generate a pressure for ejecting ink by changing a volume of the ink chamber, wherein the vibration plate includes a base layer formed at a top surface of the substrate so as to cover at least a part of the space portion, a thin film shape memory alloy which contacts the ink contained in the ink chamber and varies according to a temperature variation, a heating element disposed between the base layer and the thin film shape memory alloy to generate heat, and an insulating layer disposed between the heating element and the thin film shape memory alloy to transfer the heat generated by the heating element to the thin film shape memory alloy.

To achieve the above and other objects, according to another embodiment of the present invention, there is provided a method of manufacturing an ink-jet printhead. The method includes forming the base layer on both surfaces of the substrate, forming the heating element generating heat on the base layer, forming an electrode supplying current from an external power source on the heating element, forming the insulating layer transferring heat generated by the heating element on the electrode, forming the thin film shape memory alloy varying between states according to a temperature variation on the insulating layer, etching the substrate to form a space portion, stacking a photosensitive layer on the thin film shape memory alloy, patterning the photosensitive layer to form the passage plate, separately forming the nozzle plate in which the nozzle is formed to provide a path through which ink is ejected, and joining the nozzle plate onto the passage plate.

BRIEF DESCRIPTION OF THE DRAWINGS

The above and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
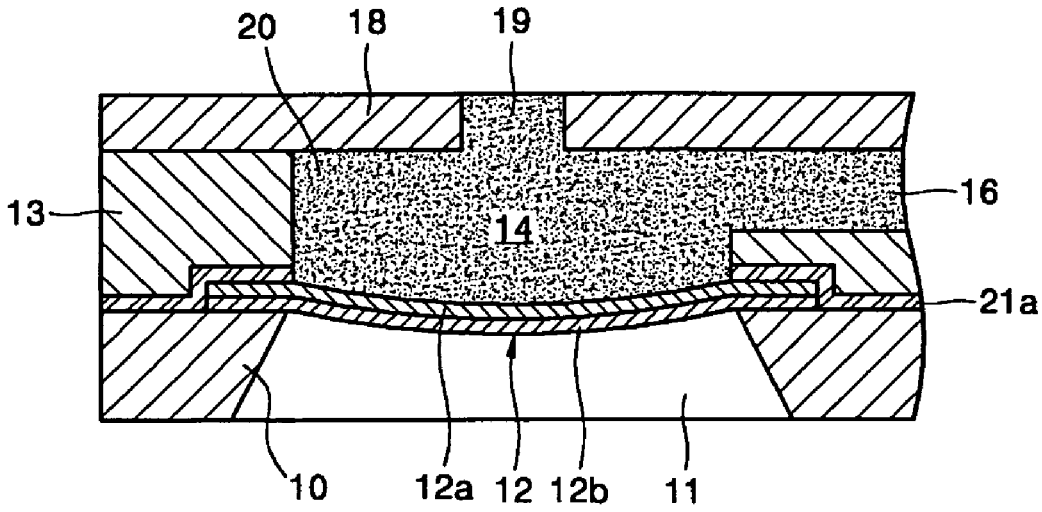
FIG. 1 (PRIOR ART)
FIG. 1 is a cross-sectional view of a conventional ink-jet printhead using a shape memory alloy.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures. Same reference numerals denote elements having same functions.

Figure 2:
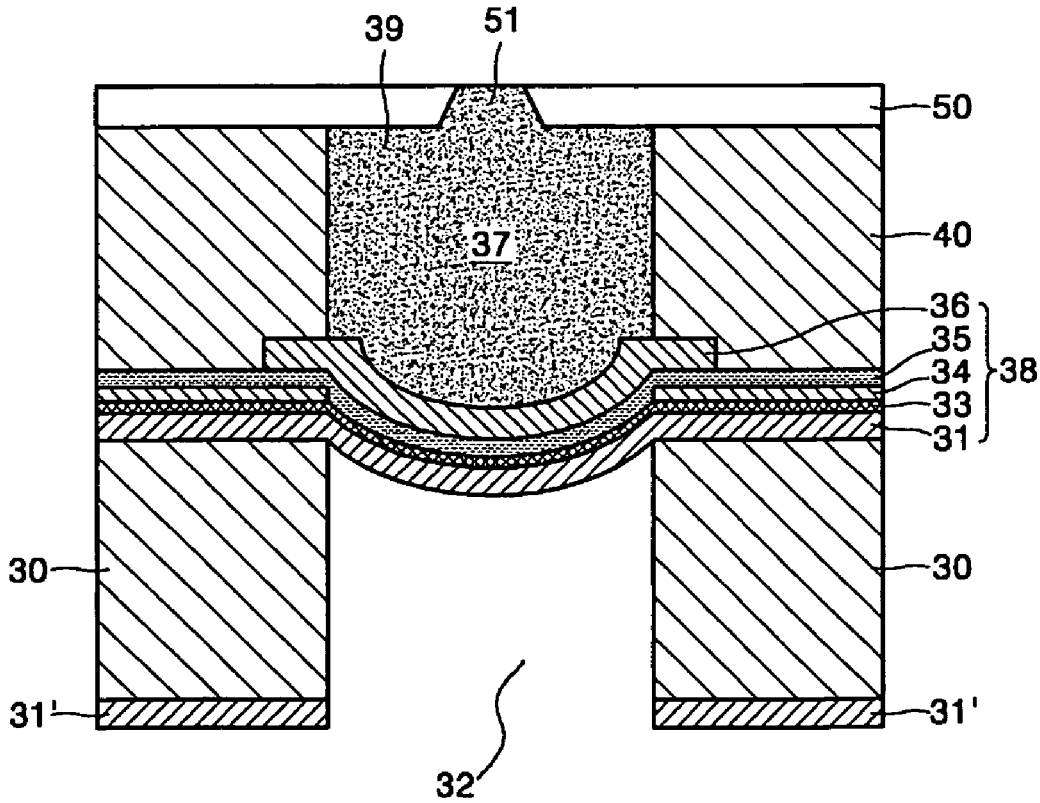
FIG. 2 is a cross-sectional view of a vertical structure of an ink-jet printhead according to an embodiment of the present invention.

FIG. 2 is a cross-sectional view of a vertical structure of an ink-jet printhead according an embodiment of to the present invention. Referring to FIG. 2, the ink-jet printhead includes a substrate 30, a vibration plate 38, an ink chamber 37, a passage plate 40, and a nozzle plate 50.

The substrate 30 is perforated from a rear side into a top surface and includes a space portion 32 covered with a base layer 31 formed on the surface of the substrate 30. According to an aspect of the present invention, the substrate 30 is formed of silicon, which is widely used in manufacturing an integrated circuit (IC).

The vibration plate 38 is installed at a top surface of the substrate 30 and ejects ink by a high pressure of the ink chamber 37, which is caused by a volume variation of the ink chamber 37, using a shape memory alloy, of which shape varies according to a temperature variation. The vibration plate 36 includes the base layer 31, a heating element 33, an electrode 34, an insulating layer 35, and a thin film shape memory alloy layer 36.

The base layer 31 is formed at the top surface of the substrate 30 to cover the space portion 32. The base layer 31 is formed of silicon oxide, SiOx, by oxidizing the substrate 30 to a thickness between 0.5 μm and 3 μm. The base layer 31 has a residual compressive stress and is bending-deformed toward the space portion 32. The heating element 33 is installed at a top surface of the base layer 31 and generates heat transferred to the thin film shape memory alloy layer 36. The heating element 33 is formed of one selected from materials, such as TaAl, NiCr, TaN, Ta, Ni, and doped Poly-Si, having resistivity more than 100 μΩ·cm and a temperature coefficient of resistance (TCR) less than ±1000 ppm.

The heating element 33 is formed on the base layer 31 through a sputtering, evaporation, or chemical vapor deposition (CVD). According to another aspect of the present invention, a melting point of the heating element 33 is higher than 800° C., and the heating element 33 has a thickness between 0.05 μm and 0.3 μm.

The electrode 34 contacts at least both sides of the heating element 33 and supplies current to the heating element 33 from an external power source. According to another aspect of the present invention, the electrode 34 has a resistivity between 10 μΩ·cm and 100 μΩ·cm and a melting point of more than 800° C., and is made of one of Al, Au, Pt, Poly-Si, and $WSi_2$. According to another aspect of the present invention, a thickness of the electrode 34 is more than 0.2 μm.

The insulating layer 35 is formed on a top surface of the heating element 33 and the electrode 34, transfers heat generated by the heating element 33 to the thin film shape memory alloy layer 36, and is electrically insulated from the heating element 33. Thus, the insulating layer 35 is formed of a passivation layer deposited on the heating element 33. The passivation layer, such as SiNx, SiC, diamond like carbon (DLC), and SiOx, has good thermal conductivity, low specific heat, high ink resistance, and excellent mechanical strength, through the CVD or sputtering. It is possible that a thickness of the insulating layer 35 is between 0.05 μm and 1 μm.

The thin film shape memory alloy 36 is formed on a top surface of the insulating layer 35, and a phase of the thin film shape memory alloy 36 is successively transformed in accordance with the temperature variation, and the thin film shape memory alloy layer 36 changes a volume of the ink chamber 37 during the phase transformation. The thin film shape memory alloy layer 36 memories an original state at a predetermined temperature through a thermal treatment (400-700° C.) and is returned from a deformed state to the original state when heat transferred from the heating element 33 reaches the predetermined temperature.

In the present invention, as shown in FIG. 2, the thin film shape memory alloy layer 36 is bent toward the space portion 32 in the deformed state during cooling, that is, when heat is not transferred from the heating element 33. The thin film shape memory alloy layer 36 is returned from the deformed state to a flat state as the original state when heat transferred from the heating element 33 reaches the predetermined temperature. And then, the thin film shape memory alloy layer 36 is bent again toward the space portion 32 when cooling. It is possible that the thin film shape memory alloy layer 36 is formed of a combination of Ni, Ti, and Cu to a thickness between 0.5 μm and 5 μm.

The ink chamber 37 is formed on a top surface of the vibration plate 38 and is surrounded by a passage plate 40 to store ink 39 to be ejected. Although the thin film shape memory alloy layer 36 directly contacts the ink 39, since the heating element 33 is separated from the thin film shape memory alloy layer 36 by the insulating layer 34, the heating element 33 does not directly contact the ink 39. Accordingly, there is no concern that the current directly flows to the ink 39.

An ink inlet (not shown) is formed in the passage plate 40. Thus, the ink 39 flows from an ink reservoir (not shown) into the ink chamber 37 through the ink inlet by a capillary action. The passage plate 40 is formed of a photosensitive material, such as photoresistive film-vacrel, Su-8, and pymel, laminated on the vibration plate 38.

The nozzle plate 50 is installed at a top surface of the passage plate 40 and includes a nozzle 51 to eject the ink 39 contained in a center of the ink chamber 37 onto a printing sheet. A diameter of the nozzle 51 is smaller than that of the ink chamber 37.

An ink ejection mechanism of the ink-jet printhead having the structure described above will be described with reference to FIGS. 3A through 3C. Reference numerals the same as those of FIG. 2 denote elements having the same functions.

Figure 3A:
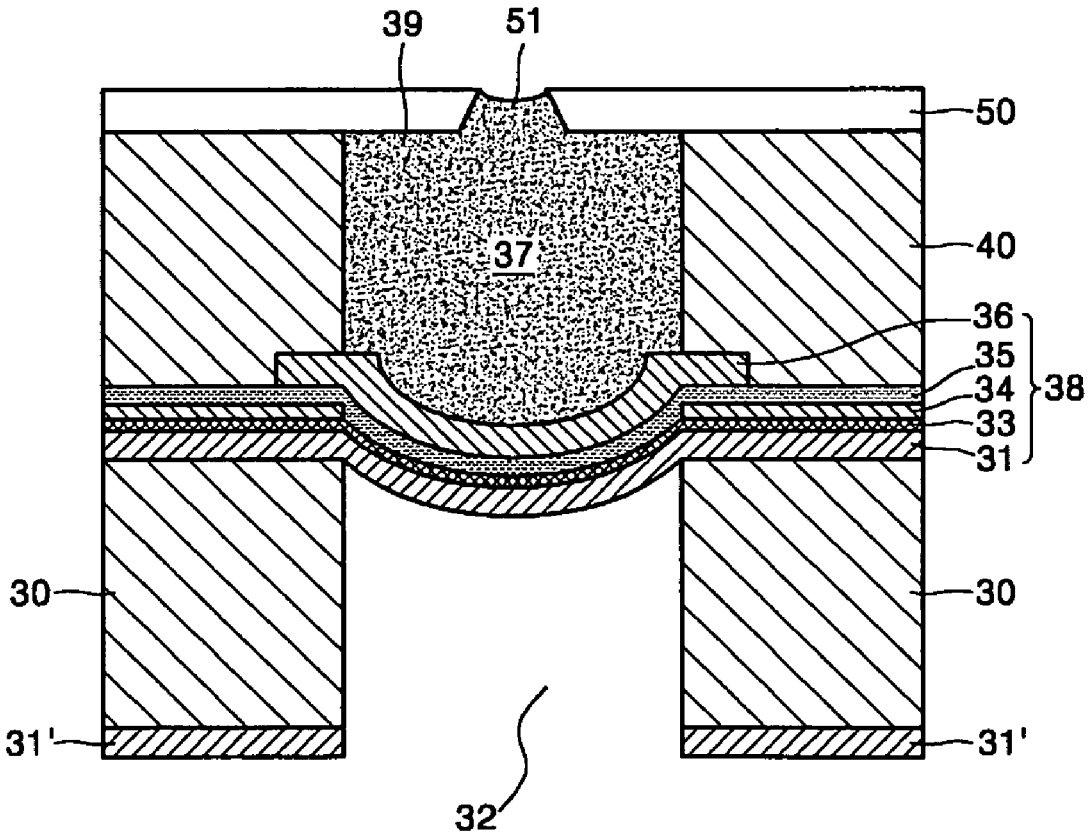
FIGS. 3A through 3C are cross-sectional views for explaining an ink ejection mechanism of the ink-jet printhead of FIG. 2.

Referring to FIG. 3A, a residual compressive stress exists in the base layer 31, and thus the base layer 31 is bent toward the space portion 32 causing a buckling phenomenon that the vibration plate 38, in which the heating element 33, the insulating layer 35, and the thin film shape memory alloy 32 are sequentially stacked on the base layer 31, is bent toward the space portion 32. Thus, the ink 39 stored in the ink reservoir flows into the ink chamber 37 through the ink inlet by the capillary action. Thus, the ink chamber 37 is filled with the ink 39.

Figure 3B:
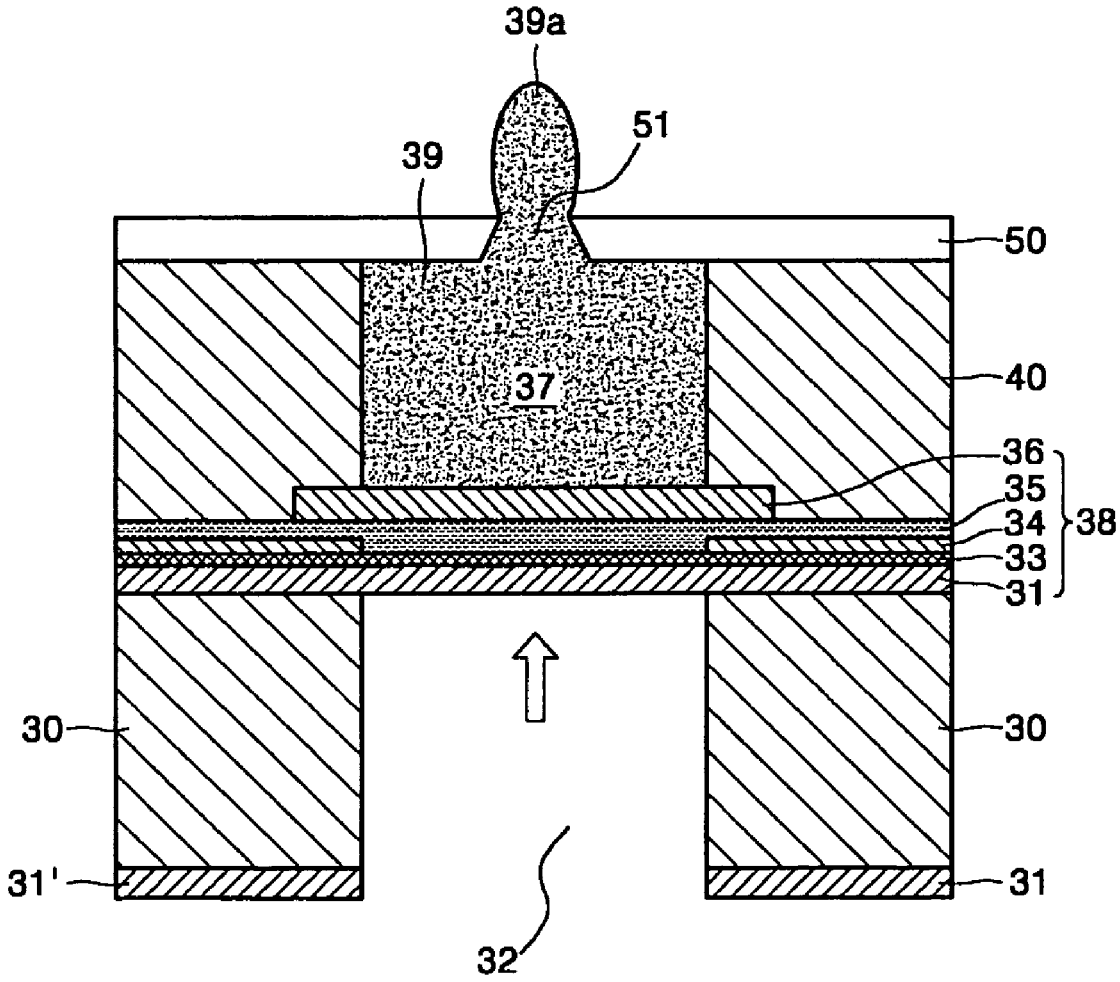

Referring to FIG. 3B, when the current flows to the heating element 33 from the external power source through the electrode 34, the heating element 33 generates heat. A portion of the heat generated from the heating element 33 may be transferred to the space portion 32 or the substrate 30 through the base layer 31, but most of the heat is transferred to the thin film shape memory alloy layer 36 through the insulating layer 35.

When a temperature of the thin film shape memory alloy layer 36 increases by the transferred heat and reaches the predetermined temperature, the thin film shape memory alloy layer 36 is in the memorized flat state as the original state. Then, the vibration plate 38 overcomes the residual compressive stress of the base layer 31 by a force with which the thin film shape memory alloy layer 36 is returned to the flat state from the deformed state. Thus, the thin film shape memory alloy layer 36 moves in an arrow direction of FIG. 3B to return to the flat state.

Thus, when the vibration plate 38 is changed to the flat state from the deformed state, a very high pressure is instantaneously formed in the ink chamber 37, and thus the ink 39 is pushed through the nozzle 51. An ink droplet 39*a* is pushed out through the nozzle 51 from the ink chamber 37.

Figure 3C:
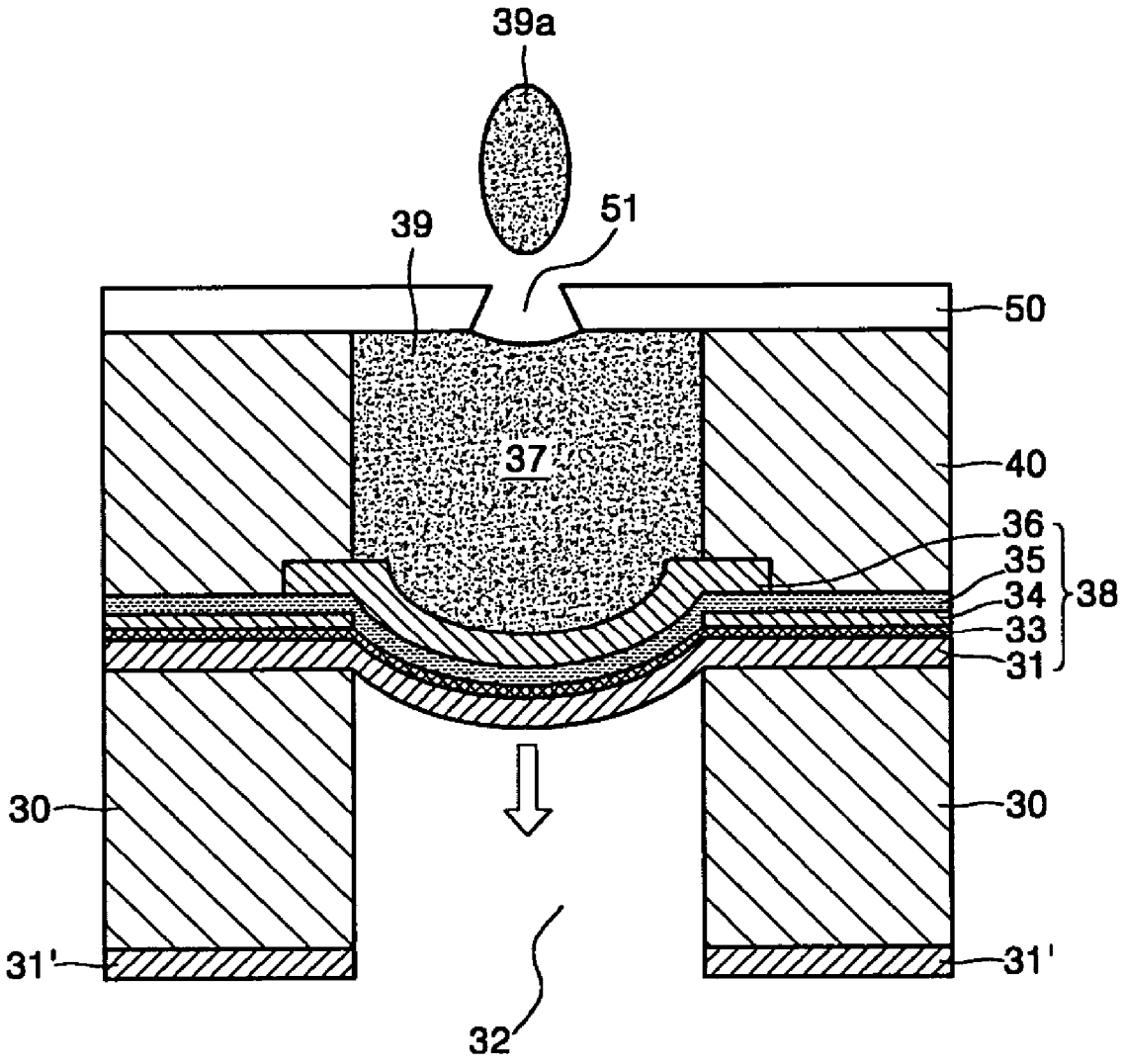

Referring to FIG. 3C, when the current is not supplied to the electrode 34, the heating element 33 does not generate the heat, and thus the thin film shape memory alloy layer 36 is cooled down. Then, the vibration plate 38 moves in an arrow direction of FIG. 3C and is bent toward the space portion 32. The ink droplet 39*a* is separated from the nozzle 51 and is ejected onto the printing sheet. New ink 39 is supplied into the ink chamber 37 through the ink inlet, and the ink chamber 37 is filled with the new ink 39.

When successively printing, the above operation is repeatedly performed, and the ink-jet printhead ejects the ink 39 onto the printing sheet.

A method of manufacturing the ink-jet printhead having the above structure according to another embodiment of the present invention will be described with reference FIGS. 4A through 4K.

Figure 4A:
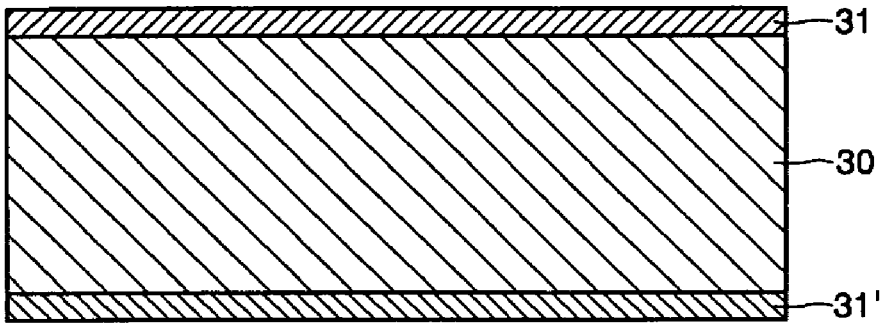
FIGS. 4A through 4K are cross-sectional views illustrating a method of manufacturing the ink-jet printhead according to another embodiment of the present invention.
Figure 4B:
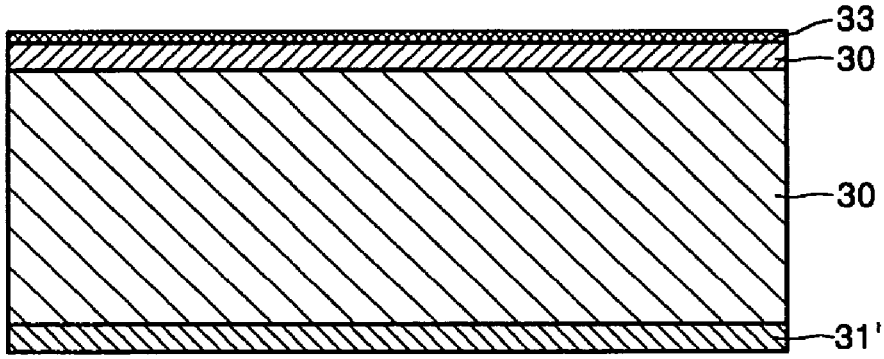
Figure 4C:
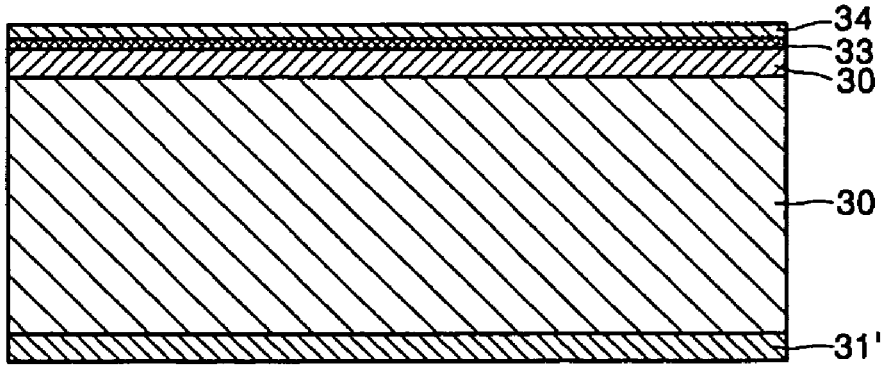
Figure 4D:
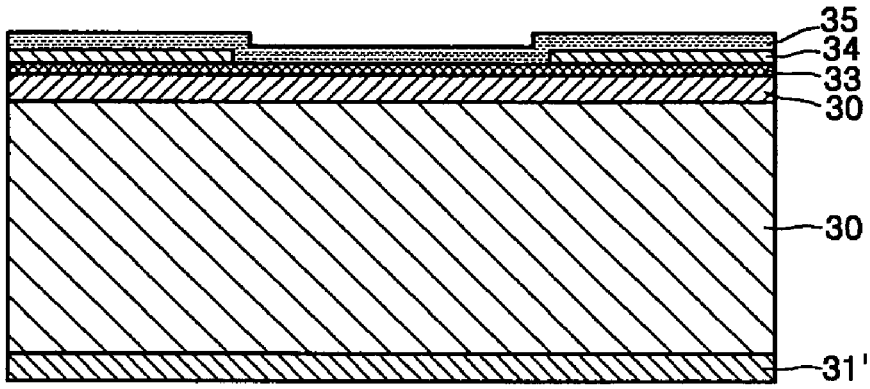
Figure 4E:
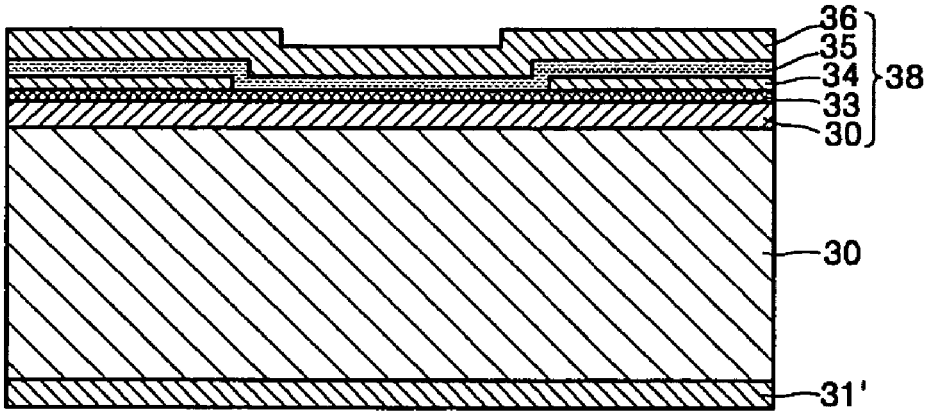
Figure 4F:
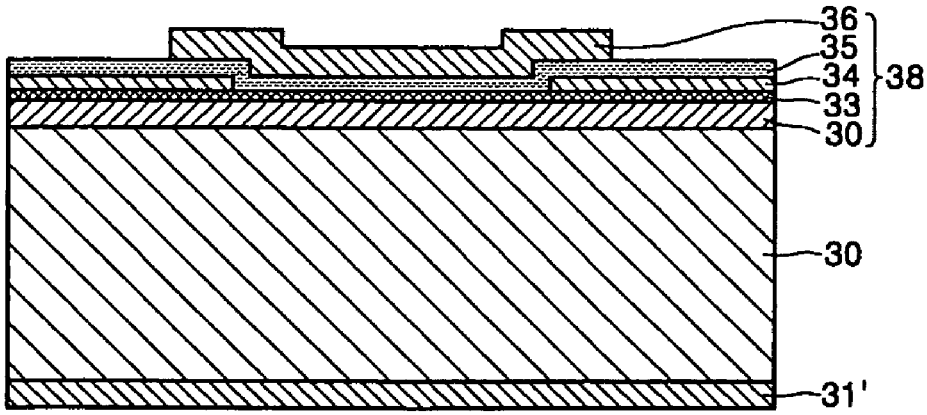
Figure 4G:
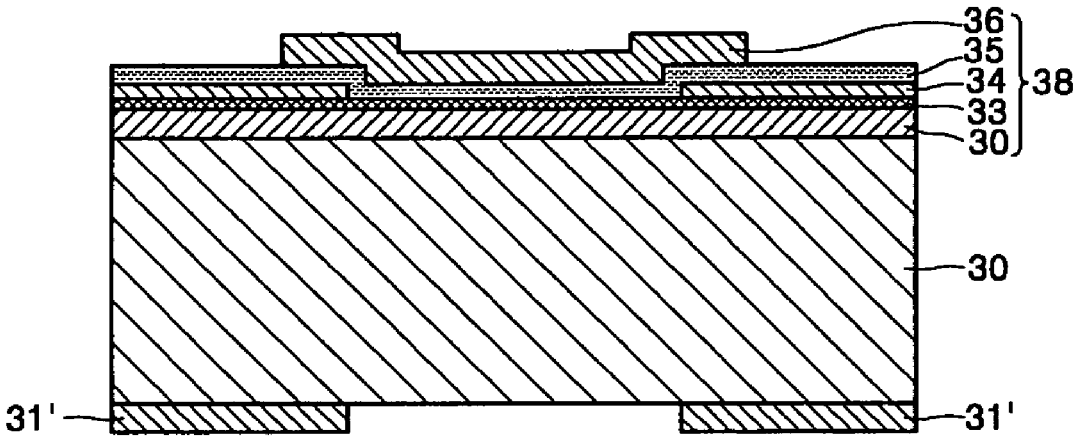
Figure 4H:
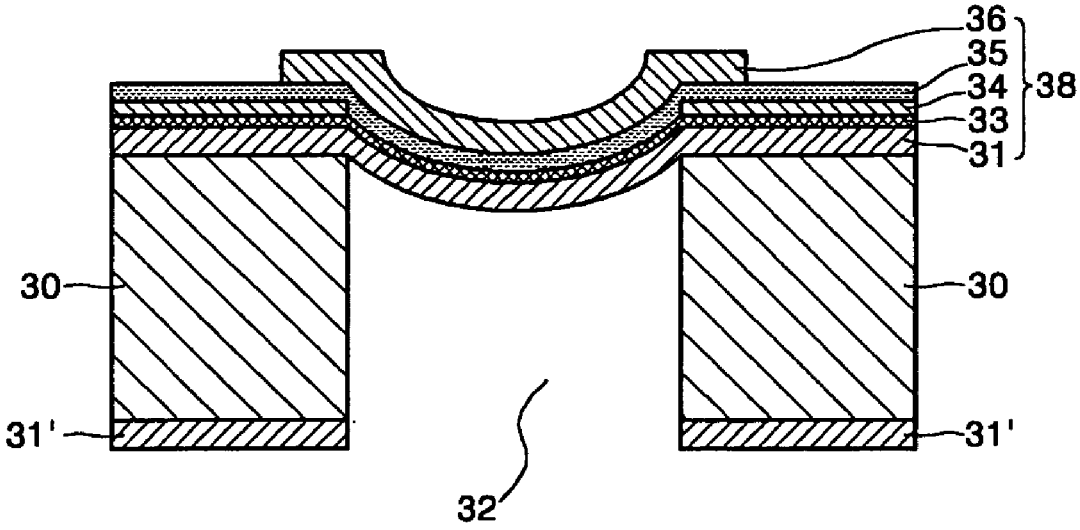
Figure 4I:
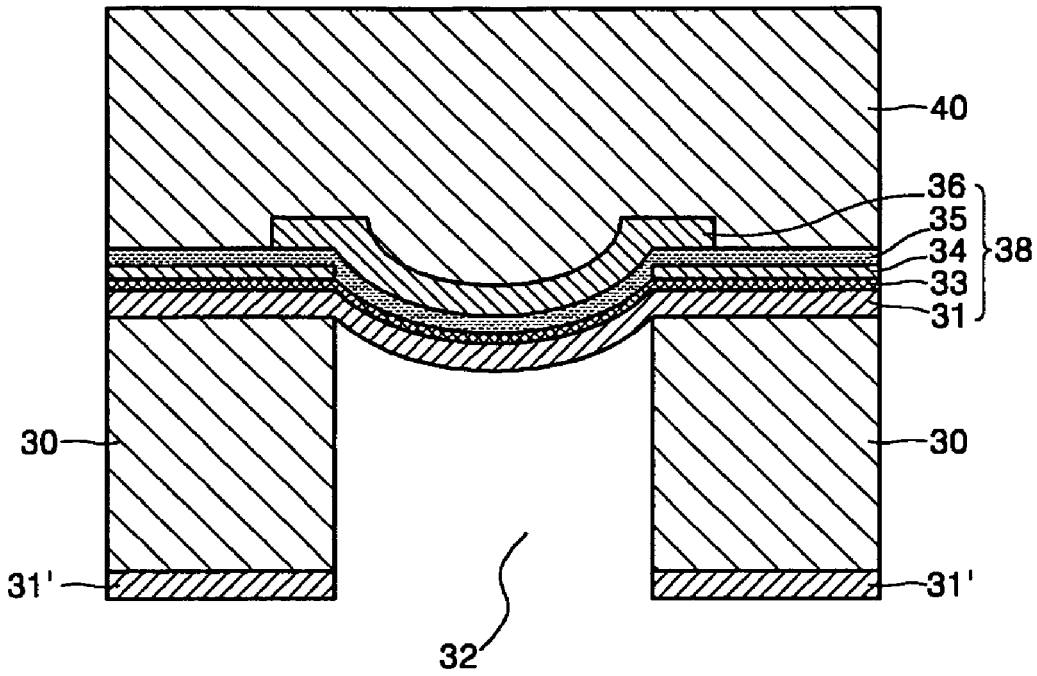
Figure 4J:
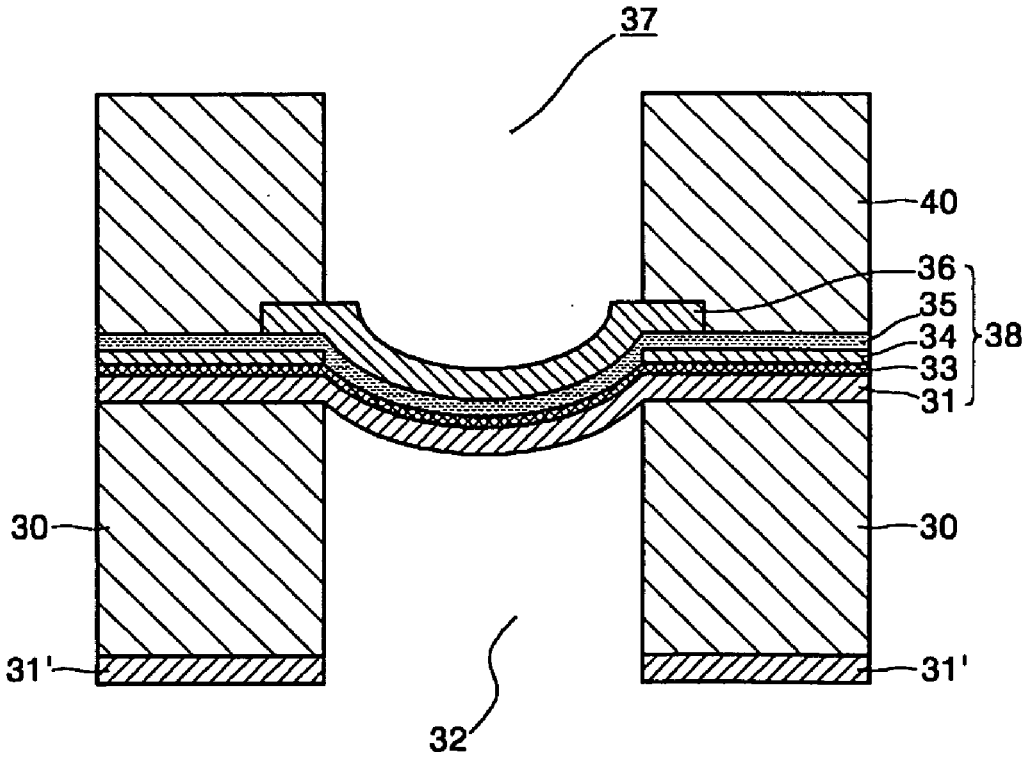
Figure 4K:
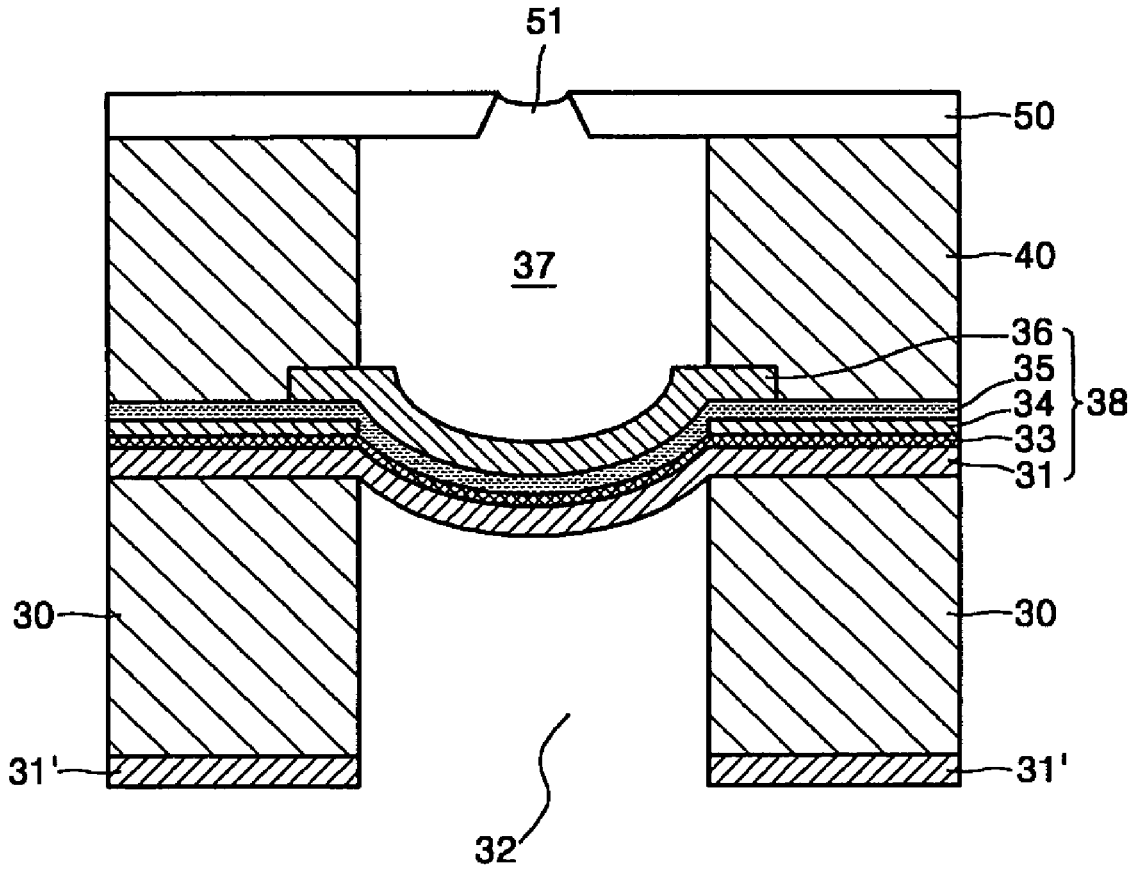

FIGS. 4A through 4K are cross-sectional views illustrating the method of manufacturing the ink-jet printhead. The method of manufacturing the ink-jet printhead is largely categorized into three operations: forming the vibration plate 38 on the substrate 30 as shown in FIGS. 4A through 4F, forming the space portion 32 as shown in FIGS. 4G through 4H, and forming the passage plate 40 and joining the nozzle plate 50, which is separately manufactured, onto the passage plate 40 as shown in FIGS. 4I through 4K.

Referring to FIG. 4A, silicon oxide layers 31, 31' are formed on the surface and the rear side of the substrate 30. A silicon substrate is used for the substrate 30 since a silicon wafer (substrate) is widely used in manufacturing a semiconductor device and can be used to be effective in mass production. When the substrate 30 is put into an oxidizing furnace and wet- or dry-oxidized, the silicon oxide layers (SOx) 31 and 31' are formed on the surface and the rear side of the silicon substrate 30. Here, the silicon oxide layer 31 formed on the surface of the substrate 30 is referred to as the base layer 31 of FIGS. 2-3C.

Referring to FIG. 4B, the heating element 33 is formed on the silicon oxide layer 31 formed on the surface of the substrate 30. The heating element 33 is formed by coating a material having a resistivity more than 100 μΩ·cm and a TCR less than ±1000 ppm to a thickness between 0.05 μm and 0.3 μm through the sputtering, evaporation, or CVD.

Referring to FIG. 4C, the electrode 34 applying the current to the heating element 33 is formed on the heating element 33. The electrode 34 is formed by coating a conductive material having the resistivity less than several tens of μΩ·cm and a thickness of more than 0.2 μm through sputtering, evaporation, or CVD.

Referring to FIG. 4D, the electrode 34 formed on the heating element 33 is patterned and etched through a lithographic process and an etching process, thereby exposing a portion of the heating element 33. A non-etched portion of the electrode 34 contacts the heating element 33.

Subsequently, the insulating layer 35 is formed on the electrode 34 and on the heating element 33. The insulating layer 35 prevents the heating element 33 and the thin film shape memory alloy layer 36 from contacting each other by separating the heating element 33 from the thin film shape memory alloy layer 36. The insulating layer 35 is electrically insulated but must transfer heat generated by the heating element 33 to the thin film shape memory alloy layer 36. Thus, the insulating layer 35 is formed of the passivation layer, which has a good thermal conductivity, a low specific heat, a high ink resistance, and an excellent mechanical strength, deposited on the heating element 33 through the CVD or sputtering.

Referring to FIGS. 4E and 4F, the thin film shape memory alloy layer 36 is thinly deposited on the insulating layer 35 through the sputtering, and the original state of the thin film shape memory alloy layer 36 is memorized through the thermal treatment at a temperature between 400° C. and 700° C. The thin film shape memory alloy layer 36 memories the flat state as the original state.

Subsequently, the thin film shape memory alloy layer 36 is patterned and etched to a size of a desired region through the lithographic process and the etching process.

Although not shown, in order to form a path through which the current flows to the electrode 34 from the external power source, an operation of etching a part of the insulating layer 35 and exposing the electrode 34 may be added. The exposing of the electrode 34 may be performed after forming the thin film shape memory alloy layer 36 as described above. By performing the above operations, the vibration plate 38 is formed on the substrate 30.

Referring to FIGS. 4G and 4H, the silicon oxide layer 31' formed on the rear side of the substrate 30 is patterned and etched, thereby exposing a part of the substrate 30.

Subsequently, the exposed substrate 30 is wet- or dry-etched to a predetermined depth, thereby forming the space portion 32. Then, the base layer 31 covering the space portion 32 is bent toward the space portion 32 by a buckling phenomenon.

Since the residual compressive stress exists in the base layer 31, the residual compressive stress is exerted from both ends of the base layer 31 to a center portion of the base layer 31, and thus the base layer 31 tends to be bent toward the space portion 32. However, since the heating element 33, the insulating layer 35, and the thin film shape memory alloy 36 are sequentially stacked on the base layer 31, and since a lower portion of the base layer 31 is disturbed by the substrate 30 before the substrate is etched to form the space portion 32, the base layer 31 is not bent in any direction. In such a case, a portion of the substrate 30 corresponding to the space portion 32 is removed to cause the base layer 31 to be bent toward the space portion 32 by the compressive stress. The base layer 31, the heating element 33, the insulating layer 35, and the thin film shape memory alloy layer 36 are joined together in the vibration plate 38 and thus are bent together.

Referring to FIGS. 4I and 4J, a photosensitive layer, such as film-shaped photoresist, is coated on the vibration plate 38 through lamination, or a photosensitive layer, such as liquid-shaped photoresist, is coated on the vibration plate 38 through spin coating. The photosensitive layer is patterned and etched, thereby forming the ink chamber 37 and the passage plate 40 surrounding the ink chamber 37. Thus, the thin film shape memory alloy layer 36 is exposed to the ink chamber 37.

Although not shown, forming the ink inlet as the path for supplying ink from the ink reservoir to the ink chamber 37 may be performed.

Referring to FIG. 4K, the nozzle plate 50, which is separately manufactured, is joined onto the passage plate 40, thereby completing the ink-jet printhead according to the present invention. The nozzle 51 is formed at the nozzle plate 50 to eject the ink 39. The nozzle plate 50 is formed through plating, polishing processing, or laser processing.

Not shown materials may be used for materials used in constituting each element of the ink-jet printhead in the present invention, and methods of stacking and forming each material are only illustrated but various deposition and etching methods may be made.

In addition, in the method of manufacturing the ink-jet printhead of the present invention, the order of the operations may be different as the demands.

As described above, the ink-jet printhead according to the present invention has the following advantages. First, a heating efficiency increases due to the high resistivity of the heating element, thereby reducing a power consumption and realizing a power-savings in driving the ink-jet printhead.

Second, due to the stable TCR of the heating element, a height and a range of voltages can be easily controlled, and thus a power can be precisely controlled, thereby exactly regulating the amount of the ejected ink and having a predetermined image quality.

Third, the heating element does not contact directly the ink, thereby realizing stability of the heating element.

Fourth, the vibration plate becomes thick, thereby increasing a shockproof property and durability of the ink-jet printhead.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A method of manufacturing an ink-jet printhead, the method comprising:

forming a base layer on both surfaces of a substrate;

forming a heating element on the base layer to generate heat in response to a current;

forming an electrode on the heating element to transmit the current from an external power source to the heating element;

forming an insulating layer on the electrode to transfer the heat;

forming a thin film shape memory alloy layer on the insulation layer to change between an original state and a deformed state according to a temperature variation corresponding to the heat transferred through the insulating layer;

etching the substrate to form a space portion;

stacking a photosensitive layer on the thin film shape memory alloy layer, patterning, and etching the photosensitive layer to form a passage plate;

forming a nozzle plate in which a nozzle as a path through which ink is ejected is formed; and joining the nozzle plate onto the passage plate to define an ink chamber, wherein the forming of the electrode comprises etching a part of the insulating layer and exposing a part of the electrode so as to connect the electrode to the external power source between the forming of the insulating layer and the forming of the thin film shape memory alloy layer, and wherein the exposing of the part of the electrode is performed after the forming of the thin film shape memory alloy layer.

2. The method of claim 1, wherein the forming of the electrode comprises etching a part of the electrode and exposing a part of the heating element between the forming of the electrode and the forming of the insulating layer.

3. The method of claim 1, wherein a thickness of the base layer is between 0.5 μm and 3 μm inclusive.

4. The method of claim 1, wherein a thickness of the heating element is between 0.05 μm and 0.3 μm inclusive.

5. The method of claim 1, wherein a resistivity of the heating element is more than 100 μΩ·cm inclusive.

6. The method of claim 1, wherein a thickness of the electrode is more than 0.2 μm.

7. The method of claim 1, wherein a thickness of the insulating layer is between 0.05 μm and 1 μm inclusive.

8. The method of claim 1, wherein a thickness of the thin film shape memory alloy layer is between 0.5 μm and 5 μm inclusive.

9. The method of claim 1, wherein the forming of the passage plate comprises coating a film-shaped photoresist on the photosensitive layer through lamination.

10. The method of claim 1, wherein the forming of the passage plate comprises coating a liquid-shaped photoresist on the photosensitive layer through spin coating.

11. The method of claim 1, wherein the forming of the nozzle plate comprises performing one of plating, polishing, and laser processes on the nozzle plate.

12. The method of claim 1, wherein the forming of the insulating layer comprises:

depositing a passivation layer on the electrode and a portion of the heating element corresponding to the ink chamber and the space portion.

13. The method of claim 1, wherein the forming of the insulation layer comprises:

performing a chemical vapor deposition or sputtering process to form the insulation layer on the heating element and the electrode.

14. The method of claim 1, wherein the forming of the insulation layer comprises:

forming an insulation material on the electrode and a portion of the heat element corresponding to both the space portion of the substrate and the ink chamber of the passage plate.

15. The method of claim 1, wherein the forming of the insulation layer comprises:

forming a uniform thickness of the insulation layer on both the electrode and a portion of the heating element corresponding to both the space portion of the substrate and the ink chamber of the passage plate.

16. The method of claim 1, wherein the insulation layer comprises a first area corresponding to the ink chamber and the space portion and a second area corresponding to the substrate, and the forming of the thin film shape memory alloy layer comprises:

forming the thin film shape memory alloy layer on the first area and a first portion of the second area of the insulation layer.

17. The method of claim 16, wherein the second area of the insulation layer comprises a second portion which is not covered by the thin film shape memory alloy layer, and the stacking of the passage layer comprises:

forming the passage layer on both a portion of the thin film shape memory alloy layer and the second portion of the second area of the insulation layer.

18. The method of claim 1, wherein the forming of the nozzle plate comprises:

separately forming the nozzle plate by performing a separate process of separately forming the nozzle plate and a stacking process of stacking the separately formed nozzle plate on the thin film shape memory alloy layer.

19. The method of claim 1, wherein the forming of the insulation layer comprises: depositing one of a compound of silicon and nitrogen, silicon carbide, diamond like carbon, and silicon oxide.

* * * * *